United States Patent [19]

Blanco

[11] 4,026,128

[45] May 31, 1977

[54] FAULTY NEEDLE SENSING

[75] Inventor: Ernesto E. Blanco, Belmont, Mass.

[73] Assignee: Universal Textile Machine Corporation, Lawrence, Mass.

[22] Filed: Dec. 12, 1975

[21] Appl. No.: 640,063

[52] U.S. Cl. ..... 66/165

[51] Int. Cl.[2] ..... D04B 35/10; D04B 35/18

[58] Field of Search ..... 66/157, 165

[56] References Cited

UNITED STATES PATENTS

| | | | |
|---|---|---|---|
| 1,292,672 | 1/1919 | Allwood | 66/157 |
| 1,292,803 | 1/1919 | Klingler | 66/157 |
| 2,161,209 | 6/1939 | Vossen | 66/157 |
| 2,661,615 | 12/1953 | Crawford et al. | 66/157 |
| 2,869,343 | 1/1959 | Toone | 66/157 X |
| 3,529,445 | 9/1970 | Brose | 66/165 X |
| 3,834,190 | 9/1974 | Kuhn | 66/157 X |
| 3,906,752 | 9/1975 | Eichhorst | 66/157 |
| 3,946,578 | 3/1976 | Venczel | 66/157 |

*Primary Examiner*—Ronald Feldbaum

[57] ABSTRACT

Apparatus for sensing faulty knitting needles includes two needle sensors that are supported in predetermined relation for concurrently sensing different portions of the same needle. An indicator produces an output indicating that a sensed needle is defective in response to a differential change indicative of a faulty needle in the output indications of the two needle sensors.

23 Claims, 30 Drawing Figures

FIG 8
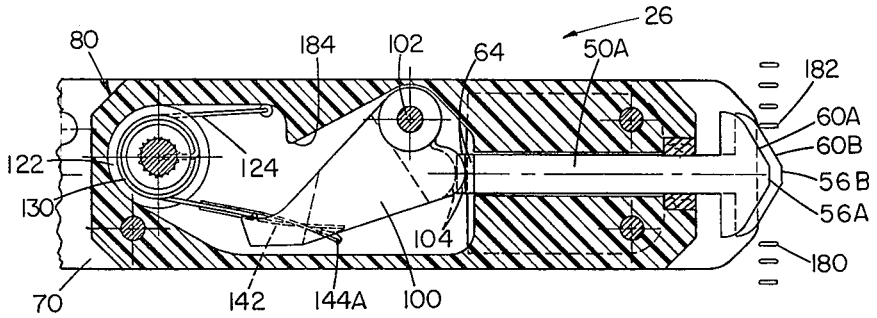
FIG 9
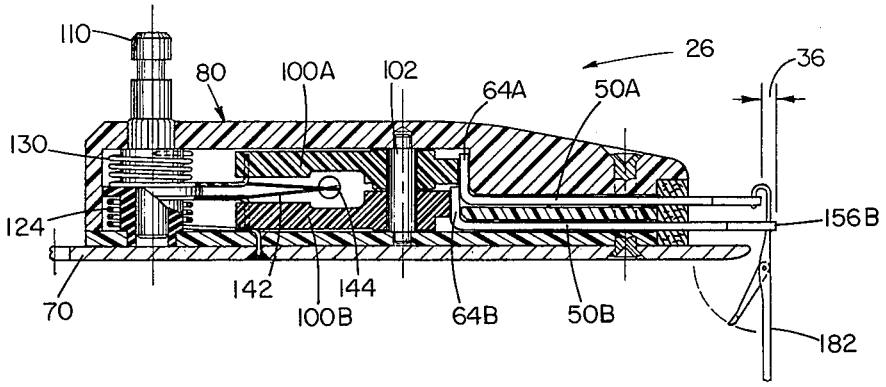
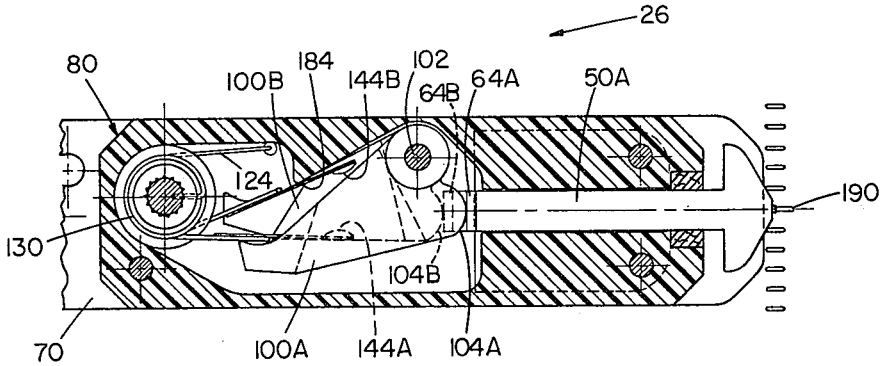
FIG 10
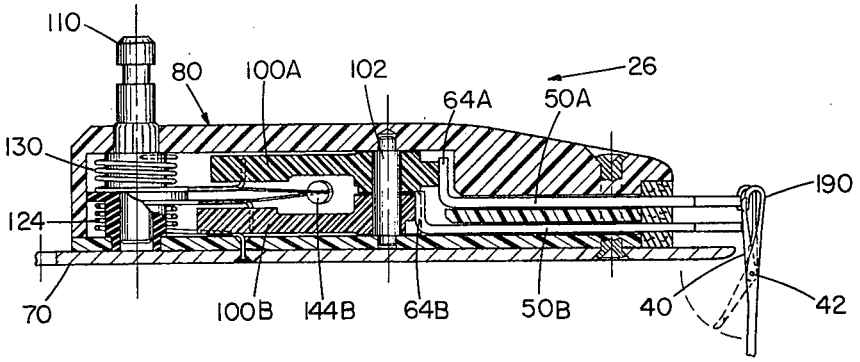
FIG 11

FIG 16
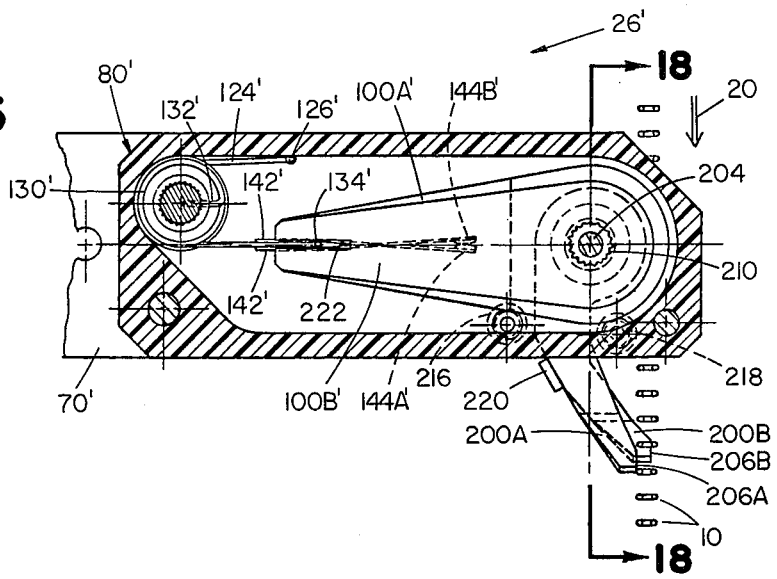
FIG 17
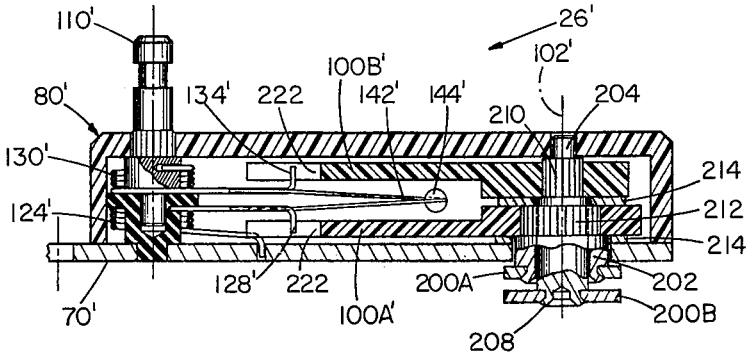
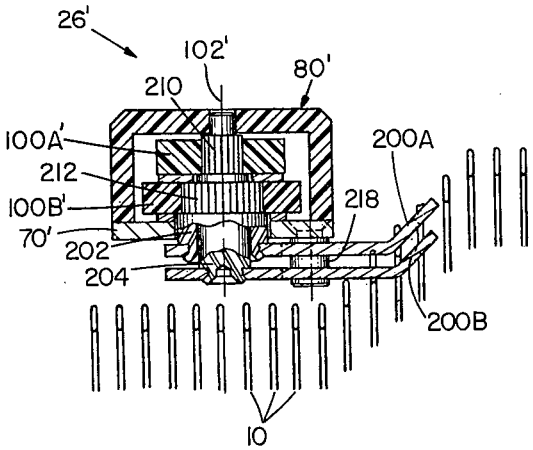
FIG 18
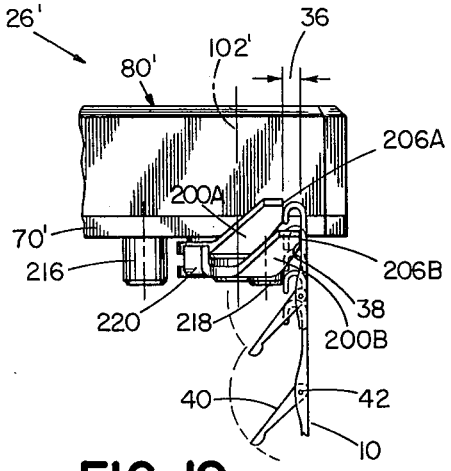
FIG 19

FIG 20
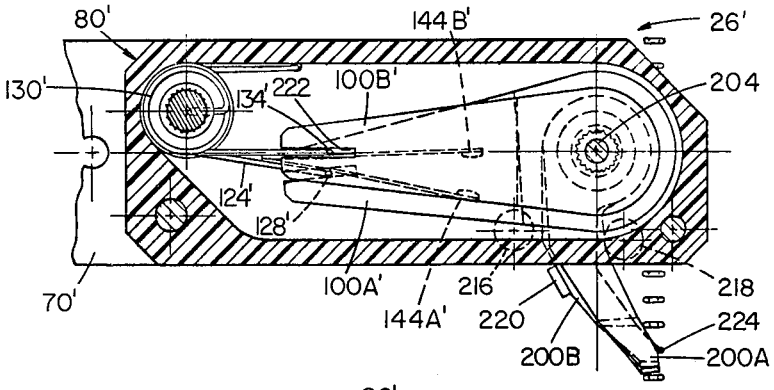
FIG 21
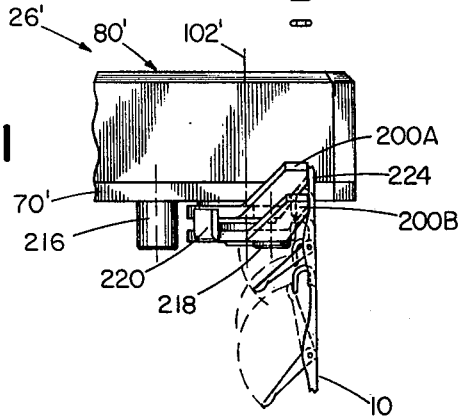
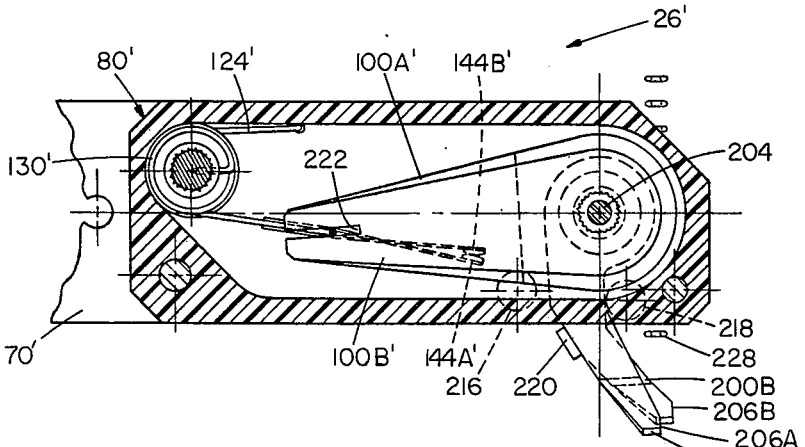
FIG 22
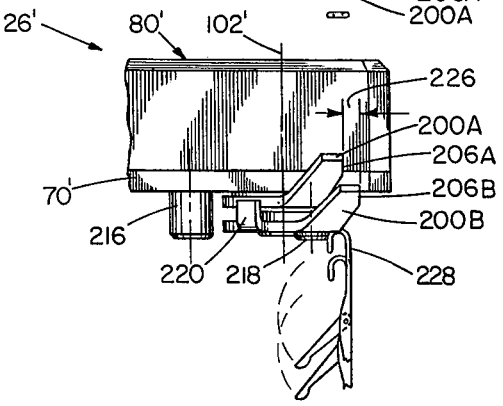
FIG 23

FIG 24
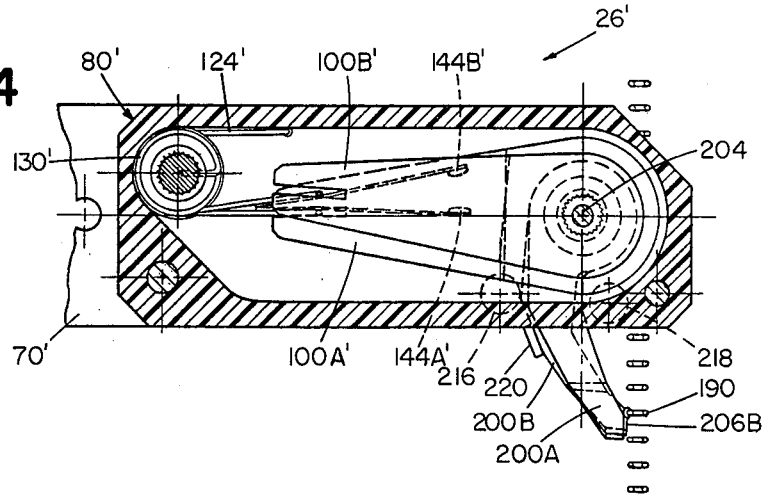
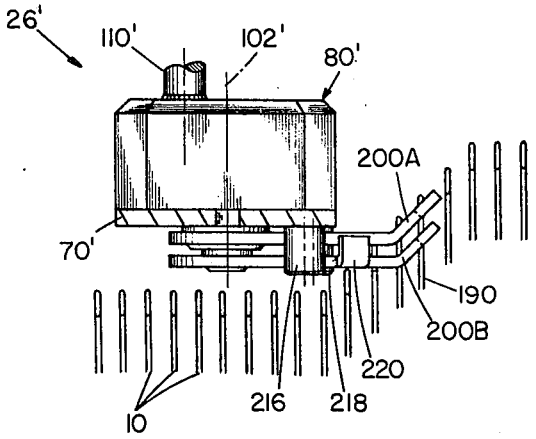
FIG 26
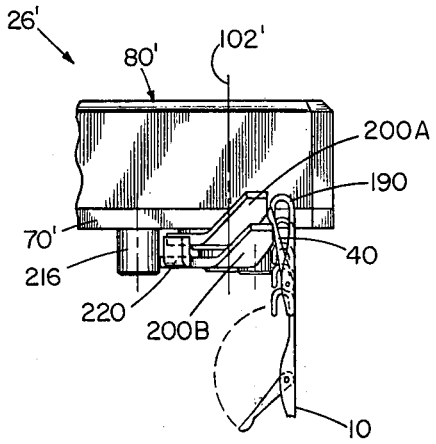
FIG 25
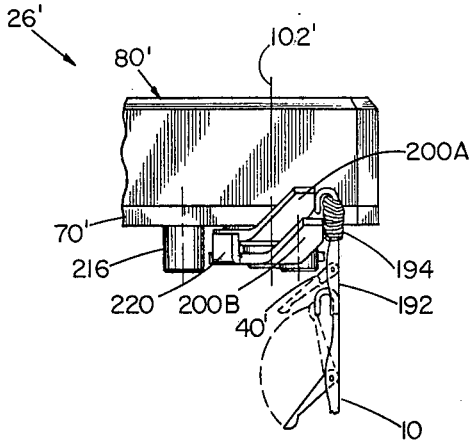
FIG 27

FIG 28
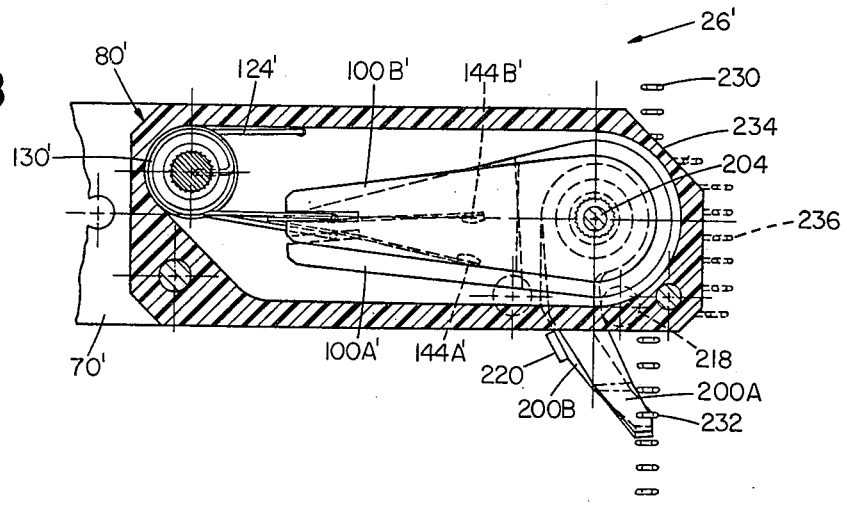
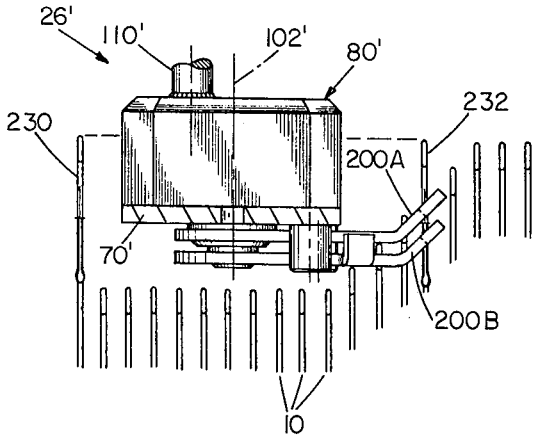
FIG 30
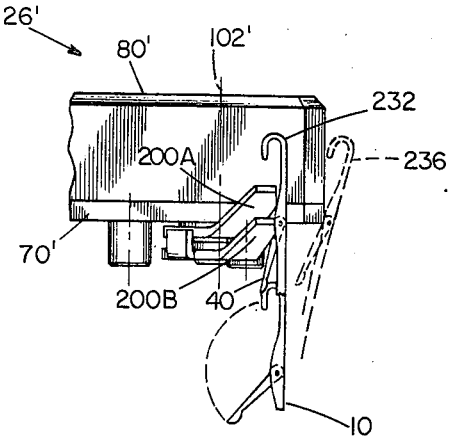
FIG 29

FAULTY NEEDLE SENSING

SUMMARY OF INVENTION

This invention is in the field of knitting machines and particularly circular knitting machines and is directed to detecting faulty needles as soon as practicable so as to avoid excessive subsequent damage and wastage.

In the course of operating a circular knitting machine, the needles are sequentially raised and lowered and also acted on by the yarn and the completed fabric. The needles are subjected to substantial cylindrical stresses and to friction, as a result of which the needles are sometimes damaged. Should a knitting needle fail to perform its intended function, the knitted fabric being produced shows a characteristic defect sometimes called a "needle line" which resembles what user's term a "run" as in stockings. When a needle is defective, proper knitting is interrupted, wastage of knitted fabric occurs and further damage to other needles or other parts of the knitting machine may result.

Latch-type knitting needles, such as the ones used in double knit machines, can fail in a variety of ways. For example, the latch may break or may become sticky and fail to open and close as freely as required, or the needle hook may break. Also, the needle tang that actuates the rise and fall of the needle may break, leaving the needle without vertical motion control. Broken or faulty needles account for substantial losses in all knitting operations, demanding constant surveillance of the equipment and limiting the number of machines tended by each operator.

While numerous devices for sensing faulty needles have been proposed over the years, none of those devices have been fully satisfactory and most of the devices for the detection of faulty needles presently on the market have failed to fulfill the expectations of industrial uses. Typically, such devices are limited to the detection of broken hooks. Among the devices that have been proposed are mechanical devices which directly contact the needles and optical, electro-optical and electrocapacitive devices, the latter, for example employing a proximity head for monitoring the frequency of passing hooks, that frequency then being compared to a standard for a machine speed. Such devices are recommended for use in locations where all the needles pass in a raised position, as at the needle gate, and if installed in some other location in needle selection machines, it is necessary to include needle logic and synchronization. Further, such devices are costly; delicate of adjustment; complex to install and maintain; and frequently require extreme cleanliness for proper operation.

It is an object of this invention to provide novel and improved arrangements for detecting faulty needles in a knitting machine.

In accordance with the invention, two sensors are employed in coordinated relation to detect a faulty needle, the two sensors being arranged to sense different portions of the same needle. While the sensors may take a variety of forms and a variety of sensing techniques may be utilized, for example, mechanical, electrical, optical or magnetic techniques or a combination thereof, in particular embodiments, mechanical devices are employed as sensors with one sensor positioned to engage a hook portion of a needle and a second sensor positioned to simultaneously engage a stem portion of the same needle. A differential signal is produced by two sensors and produces outputs as a function of the sensed needle portions. If the sensed needle is good and is in proper position at the sensor location, a differential of predetermined value between the sensor outputs results. Should the sensed needle be defective, however, in that, for example a hook is broken or bent out of alignment or otherwise damaged, or excessively worn, the differential between outputs changes and an indicator responds to that changed differential to provide an output indicating that the sensed needle is defective. This output indication may be used to activate an alarm indicating that a defective needle has been sensed and also to activate a stop motion device of conventional design to stop the knitting machine.

In particular embodiments each needle sensor has a surface for engagement with a portion of a needle to be sensed, the length of the sensor surface being sufficient to bridge two, but not three, adjacent needles in the needle array being sensed. One needle sensor is supported so that its sensing surface is disposed for sensing the hook portion of a needle and the other needle sensor is supported so that its sensing surface is disposed for concurrently sensing the stem portion of a needle immediately below the hook portion. An indicator responds to relative movement of the two needle sensors and controls an electrical circuit. The indicator preferrably has a controlled or damped response which permits a limited amount of sensor movement before the indicator produces a signal indicative of a faulty needle and in particular embodiments includes two prebiased electrical switch contacts, one coupled to each needle sensor. Sensor movement of at least about 0.010 inch or a reduction of at least one-fourth the normal sensor offset is required in particular embodiments to cause the indicator to produce a faulty needle signal.

Needle sensor arrangements in accordance with the invention are capable of detecting a variety of needle defects, including broken tang defects and broken latch defects and are suitable for use with a wide range of needle gages. In particular embodiments the sensor apparatus has internal and external stop structures and is a compact and sturdy unit. Apparatus in accordance with the invention is versatile in application and may be mounted for sensing cylinder needles and/or dial needles in a circular knitting machine and reliably detects faulty needles.

Other objects, features and advantages of the invention will be seen as the following description of particular embodiments progresses, in conjunction with the drawings, in which.

Figure 6:
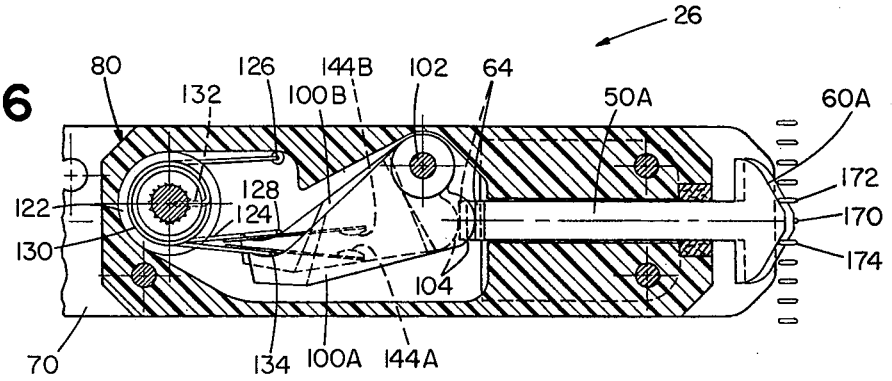
FIGS. 6 and 7 are views similar to FIGS. 2 and 3 showing the position of components of the detecting device when sensing a needle having a broken hook.
Figure 7:
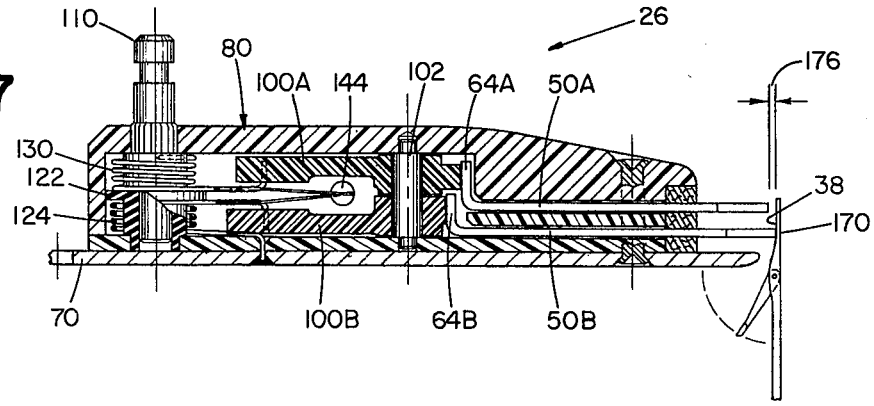

FIGS. 8 and 9, 10 and 11, 12 and 13, and 14 and 15 are views similar to FIGS. 6 and 7, showing the position of components when sensing other needle conditions;

FIG. 16 is a top view, partially in section, of another embodiment of the invention;

FIG. 17 is a sectional side view, partially in section, of the device shown in FIG. 16;

FIG. 18 is a sectional view taken along the line 18—18 of FIG. 16;

FIG. 19 is a side view of a portion of the sensing device shown in FIGS. 16–18 showing the sensor arms in engagement with a good needle;

FIGS. 20 and 21, 22 and 23, and 24 and 25 are plan and side views similar to FIGS. 17 and 19, respectively, showing the position of components of the sensor device when sensing specific needle configurations;

FIG. 26 is an end view showing the position of components of the sensor device in FIGS. 24 and 25;

FIG. 27 is a side view similar to FIG. 25 showing a needle with a broken latch; and FIGS. 28–30 are plan, side and end views similar to FIGS. 24–26, respectively, showing the position of components of the sensor device when sensing a needle with a broken tang.

DESCRIPTION OF PARTICULAR EMBODIMENTS

Figure 1:
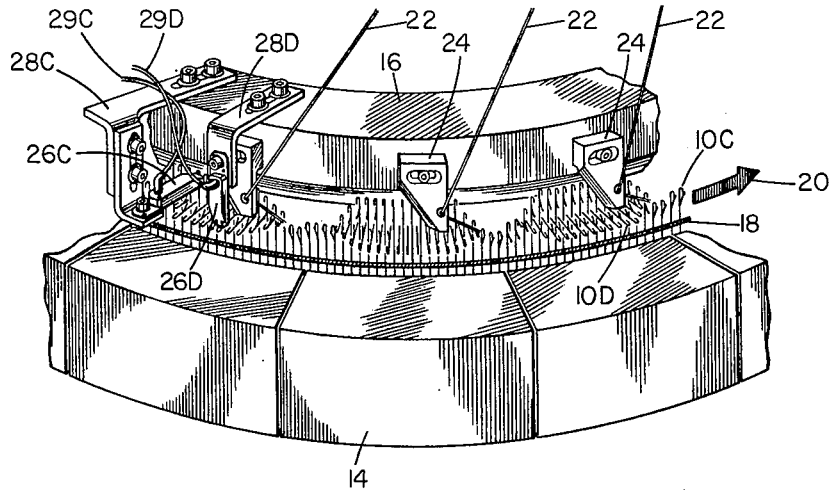
FIG. 1 is a simplified perspective view of a portion of a circular knitting machine showing installation of apparatus for detecting defective needles constructed in accordance with the invention.

The circular knitting machine illustrated in FIG. 1 has a set of cylinder needles 10C and a set of dial needles 10D. Cam blocks 14, attached to stationary base plate, control the up and down motion of the cylinder needles 10C and dial ring 16 contains cams that control the in and out motion of dial needles 10D. Garter spring 18 presses cylinder needles against the cylinder that revolves in the direction indicated by arrow 20. Yarn 22 is fed through feed blocks 24. A sensor 26C for sensing defective cylinder needles 10C is supported from bracket 28C and a similar sensor 26D for sensing defective dial needles 10D is mounted on bracket 28D. Electric leads 29C, D are connected to sensors 26C, D, respectively. Each of the needles 10 normally includes a tang (not shown) which extends outwardly radially from the lower end of the needle. As indicated in FIG. 3, each cylinder needle 10C and dial needle 10D has a stem 30 extending upwardly from the tang, a hook 32 at the upper end of the needle that has a portion 34 offset radially a distance 36 from the upper portion 38 of the stem, and a latch 40 pivoted at 42 for movement towards and away from the hook 34. A portion of the row of needles 10 is diagrammatically indicated in FIG. 2. The spacing of the needles is a function of the gage, the needles in a 25 gage system being spaced 0.04 inch and the offset 36 of such needles being about 0.04 inch. In the course of knitting, the tangs of the needles 10 are acted upon the cams to raise and lower the needles (or move them out and in) so as to engage yarn fed to them. In the coacting with the knitting cams, the yarn and the completed fabric, the needles 10 are subjected to various stresses and frictional forces. Among the areas subject to breakage are the hook 32, the latch 40 and the tang. A defective needle will knit defective fabric and possibly cause damage to other needles or other parts of the knitting machine. It is therefore important to detect defective needles as early as possible.

A device for detecting defective needles is generally shown at 26 and employs two sensors 50A, 50B, sensor 50A being disposed to sense the radially offset hook portion 34 and sensor 50B sensing the stem portion 38 of the needle between the hook 32 and the latch pivot 42. Sensors 50A and 50B monitor the offset 36 between hood surface 34 and stem surface 36.

Figure 2:
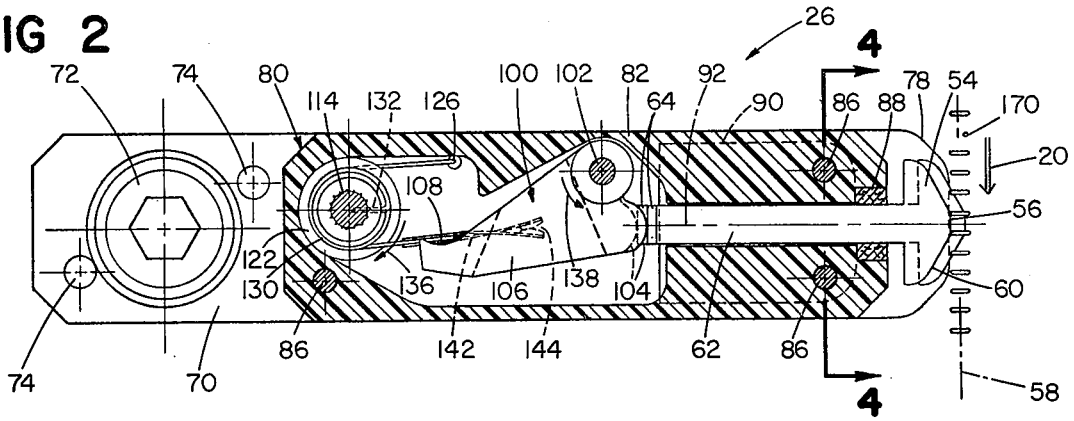
FIG. 2 is a plan view, partially in section, of one of the sensing apparatus shown in FIG. 1.
Figure 3:
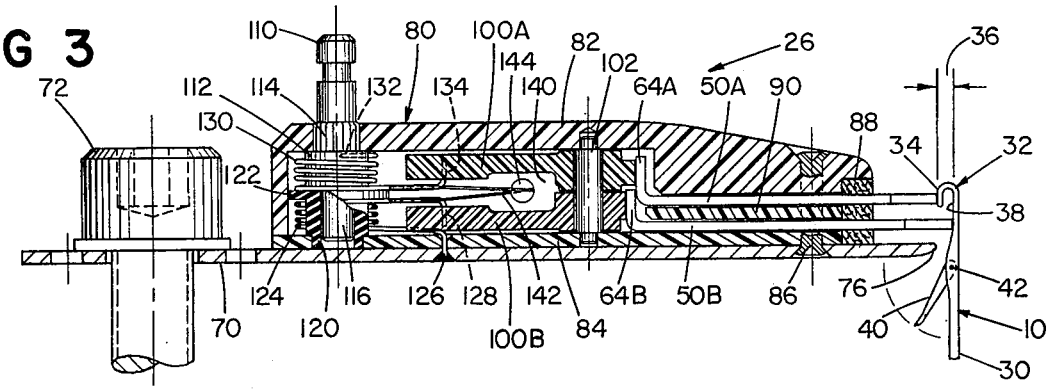
FIG. 3 is a sectional side view of the apparatus shown in FIG. 2.

As indicated in FIGS. 2 and 3, each sensor 50A, 50B is in the form of a high carbon steel plate that is hardened and polished to resist the wear caused by the passing needles 10 against which the front tips of both plates rest lightly. The head 54 of each sensing member is shaped like a blunt arrowhead with a sensing surface 56 at its tip disposed generally parallel to the needle path 58 and two sides 60 slanted at a shallow angle to the path of the needles to minimize the force component acting on the needles when the sensing plate is moved by the needles. This symmetrical head configuration enables the device to be used with needles that travel in either the direction indicated by arrow 20 or the opposite direction. The length of the tip surface 56 of each sensing member 50 corresponds to the needle spacing (gage) so that the sensing surface 56 is of length sufficient to bridge two adjacent needles and there is minimal vibration of the sensing plates when a series of needles that are not defective are sensed. The shank 62 of each sensing plate is a straight and smooth strip portion which serves as a guide stem. The end of each sensing plate opposite the sensing head is bent to form a tab 64 which functions as a flat cam follower and also limits the forward motion of the sensing plate.

The two sensors 50A, 50B are mounted in an assembly that includes a base plate 70 designed to be attached to a bracket 28 or other stationary part of the frame of the knitting machine by means of a bolt 72 and two dowel pins (not shown) that fit accurately into the corresponding dowel holes 74 in the base plate 70 near the anchoring bolt 72. Depending on the space configuration of each knitting machine an intermediate bracket or other suitable means may be used to attach the sensor base plate 70 to the machine frame. The exact configuration of the bracket or mounting means may vary widely depending on the design of the knitting machine considered.

As best indicated in FIG. 3 the front face 76 of the base plate 70 is located immediately adjacent and above the latch pivot 42 but spaced from the needles 10 at all times. That face 76 has chamfered edges or corners 78 that act to close by cam action a partially closed latch 40 of an incoming needle that does not hang freely. A needle latch 40 that passes normally under the base plate 70 could knit properly, because, even if only partially open, it will be completely opened by action of the yarn feed plate. In order to reduce the frictional forces when the front face 76 of the base plate 70 deflects a defective needle, the chamfered surfaces 78 of the base plate 70 are rounded and polished.

Figure 4:
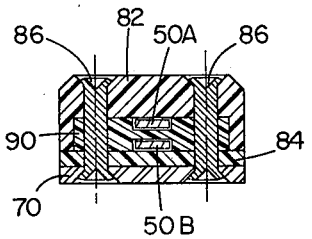
FIG. 4 is a sectional view taken along the line 4—4 of FIG. 2.

A housing 80 of two plastic members 82, 84 is mounted on the base plate 70 and secured by three rivets 86. That housing has a recess at its forward end (adjacent the needles) which receives a soft oil impregnated felt seal 88. Rearward of seal 88 is a recess which houses a plastic insert 90 (see FIG. 4) that serves as a lateral guide for the stems 62 of both sensing plates 50 and at the same time as a spacer between them. The insert 90 is fitted into the cavity in the upper housing member 82 and secured in place by the two front rivets 86. The two stems of the sensing plates are therefore capable of moving in and out of the housing with a minimum of friction. The oil impregnated felt seal 88 assures that dust, lint, fibers etc. are kept from entering and affecting the free motion of the sensing plates 50 as well as other internal moving parts.

Mounted in the housing 80 rearward of the sensing plates 50 is an indicator assembly that includes two levers 100 pivotally mounted for free movement at common shaft 102. Each lever has a cam surface 104 and an arm portion 106 that has a curved surface 108 along one side. The radial distance from shaft axis 102 to surface 108 is about three times the distance of shaft axis 102 from the normal to the axes 92 of the sensors 50 providing a 3:1 mechanical amplification.

Rearward of the two indicator levers 100 is a terminal arbor 110 to which conductor 29 (FIG. 1) is connected. Arbor 110 is provided with a body portion 112, a short knurled section 114 above body portion 112 and a stub portion 116 below body 112. The knurled section 114 is press fitted into a bore in the top housing member 82 and is intended to prevent rotation of the terminal 110. The lower end 116 of terminal 110 is press fitted into an insulating sleeve 120 which in turn is inserted into the housing base member 84 and has an isolating flange 122. A first torsion spring 124, disposed over sleeve 120, has one end 126 bent and inserted through a hole in housing member 84 and soldered into a hole in base plate 70 to provide a good ground contact. The other end of ground spring 124 has a bent tang 128 which engages curved surface 108B of actuator lever 100B. A similar torsion spring 130 is disposed over arbor body 112 and has a first end 132 inserted into a small hole drilled into the terminal arbor body 112 and a tang 134 at the opposite end that engages surface 108A of actuator lever 100A. Each torsion spring 124, 130 is wound so as to apply a load on its actuator lever 100 in the clockwise direction (indicated by arrow 136 in FIG. 2) and therefore to impress a counterclockwise torque load on its lever as indicated by arrow 138. These torque loads serve to apply axial loads to the sensing members 50 through interaction of the cam surfaces 104 and the tabs 64 of sensor plates 50.

Recesses 140 are formed in the adjacent internal surfaces of the actuator levers 100. Extending into the space provided by these recesses 140 are electrical conductors in the form of fine wires 142 that are supported from each torsion spring adjacent its tang and on which is mounted a gold contact disc 144 that has a highly polished convex surface. The convex surfaces of the gold contacts 144 face one another and deflect the support wires 122 to provide a slight preload on the contacts 144 when the actuating levers 100 are in normal position with the spring tangs aligned as indicated in FIG. 2. This contact preload minimizes the possibility of contact separation and production of a spurious signal due to normal vibratory conditions to which the sensor assembly is exposed during operation. While this embodiment employs a normally closed switch, it is also possible to use a similar system with a normally open switch in which the closing of the contacts will produce a stop signal.

Figure 5:
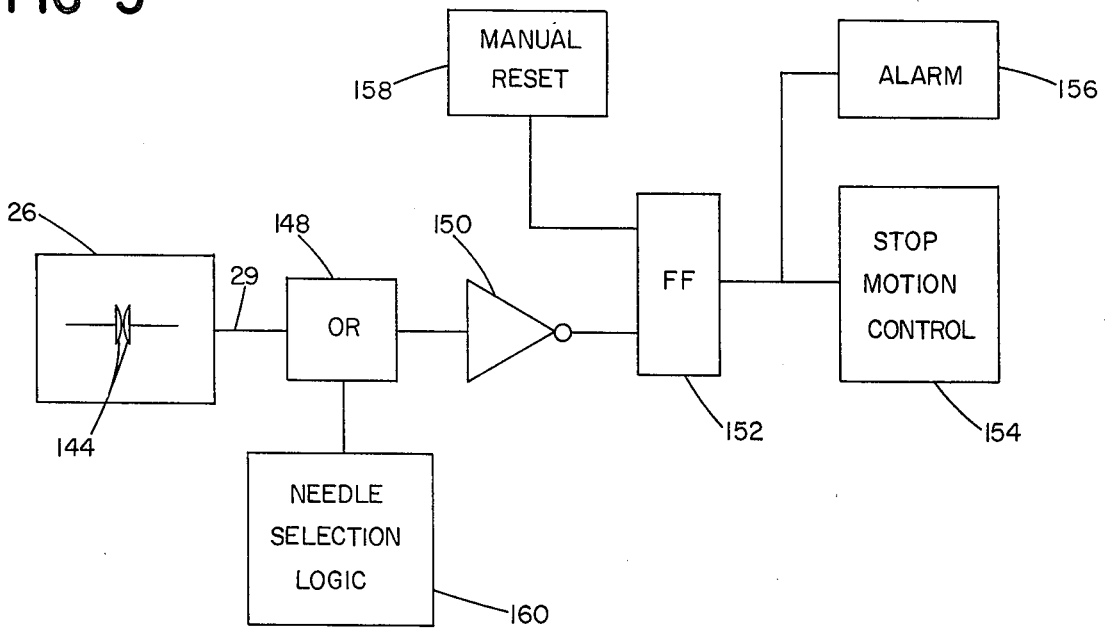
FIG. 5 is a block diagram of an electrical circuit used in connection with the detecting device shown in FIGS. 2–4.

A suitable circuit for use in connection with this sensor system is shown in block diagram form in FIG. 5. The contacts 144 for sensor 26 are connected in series through OR circuit 148 to inverter 150. The output of inverter 150 is applied to the set input of flip flop 152 of conventional design. When set, flip flop 152 produces an output which is applied to stop motion control 154 and alarm 156. The stop motion control 154 may be any standard device for stopping the motor operating the knitting machine and causing the needle cylinder to stop rotating. The alarm 156 may be a light, a bell, or other device for calling the attention of a machine attendant to the fact that a defect is indicated. OR circuit 148 may, in particular embodiments, have an input from needle selection logic 160. As long as contacts 144 remain closed, inverter 150 does not produce an output. If contacts 144 open (in the absence of an override signal from needle selection logic 160), inverter 150 produces an output to set flip flop 152 and actuate the stop motion logic 154 and alarm 156. The flip flop may be reset by switch 158 after the defect is repaired and the knitting machine motor restarted by appropriate manual means.

In operation, the needles 10 move past the sensor assembly 26, travel in either direction being accommodated by the axisymmetric configuration of the end portions 54 of the sensors 50. With normal needles as indicated in FIGS. 2 and 3, the sensors 50 are maintained at the preset offset 36 and the contacts 144 remain closed. Small misalignments or eccentricities between needles 10 as well as small radial differences in the position of the sensor assembly relative to the needle line do not open the contacts 144. In the case of a sensor unit for use with 25 gage needles, a reduction in offset 36 of about 0.010 inch is required to open contacts 144.

Whenever a needle with a broken hook (as indicated at 170 in FIGS. 2, 6 and 7) passes in front of the tips of the sensor plates, the stem sensor 50B will remain in its original position since the needle stem 38 does not vary from the normal needle line. However, since the faulty needle 170 has no hook, torsion spring 130 acting on actuator lever 100A will move hook sensor 50A forward into the empty space as far as is allowed by the hook portions 34 of two adjacent needles 172, 174. The differential distance between the two sensor tips is reduced from the normal value 36 to a lesser value 176. Torsion spring 130 rotates actuator lever 100A in the counterclockwise direction and contact 144A moves to the right away from the ground contact 144B (with a 6:1 mechanical amplification) opening the circuit between those contacts and generating a signal to actuate the alarm 156 and the knitting machine stop motion 154. The hook portion 32 of the following needle 172 cams along the lead surface 60 of sensor 50A and moves that sensor back to its normal operating position, thereby reclosing the internal contacts 144 and restoring the circuit between those contacts. However, the knitting machine is stopped by the actuated stop motion 154 and the alarm 156 remains actuated until flip flop 152 is reset.

In the case of knitting machines of the needle selection type where the needles are selected mechanically or electronically, the stop motion signal should not be generated when a selected needle is not raised at the sensing station. This stop motion override may be produced electrically as with an override signal from needle selection logic 160 through OR circuit 148 when a needle is not to be raised. Alternately, the sensor unit 26 may be arranged not to generate a stop motion signal in that event. In the embodiment shown in FIGS. 2 and 3, and as indicated in FIGS. 8 and 9, whenever a space devoid of needles 10 (e.g. between needles 180 and 182) is in front of the sensor unit 26, both sensor members 50A and 50B move forward simultaneously without change in their relative tip spacing, and both sensors 50 are stopped in their forward travel when their rear tabs 64 engage coresponding restraint surfaces in the housing. Thus the differential 36 between the front tips does not change significantly and both actuator levers 100 rotate the same amount, moving the contacts 144 as indicated in FIG. 9 but not causing those contacts to separate. Thus no stop motion signal is generated.

As the knitting needles continue in motion across the front of the sensor unit 26, a raised needle 182 (FIGS. 8 and 9) will eventually contact leading surfaces 60 of the sensor heads 50, and as both sensor heads have the same end surface configuration, that needle 182 will cam along those inclined surfaces 60 and move the sensor plates 50 rearward into their normal operating positions. That camming action will correspondingly move the actuator levers 100 in the clockwise direction about pivot 102 to return contacts 144 to the FIG. 3 position without opening them. The small preload deflection between contact support wires 142A, 142B maintains the contacts 144 closed, thus preventing accidental opening due to vibration.

Still another case is illustrated in FIGS. 10 and 11. When a needle latch 40 fails to open normally, and remains in the closed position as in needle 190 indicated in FIG. 11, the sensor assembly 26 will respond as indicated in FIGS. 10 and 11. The closed latch will force the stem sensor 50B backward into the housing, rotating the stem actuator lever 100B in the clockwise direction and opening contacts 144A, 144B, contact 144B being moved until the actuator lever 100B contacts stop surface 184, preventing further rearward movement of stem sensor 50B. It will be noted that sensor 50B may impose a slight deflection on needle 190 away from the normal needle line until that needle is past the stem sensor due to travel limits imposed on the actuator levers 100 by stop surface 184. Such travel limits enable the overall size of the sensor assembly 26 to be reduced and also limit the permitted range of movement of the sensor 50. The hook sensor 50A will sense the end of the closed latch 40 which position is substantially the same as that of the stem sensor 50B, reducing the differential between the two sensors 50A, 50B to zero. The stop motion 154 and alarm 156 are actuated in response to opening of contacts 144 and will remain actuated until reset.

Figure 12:
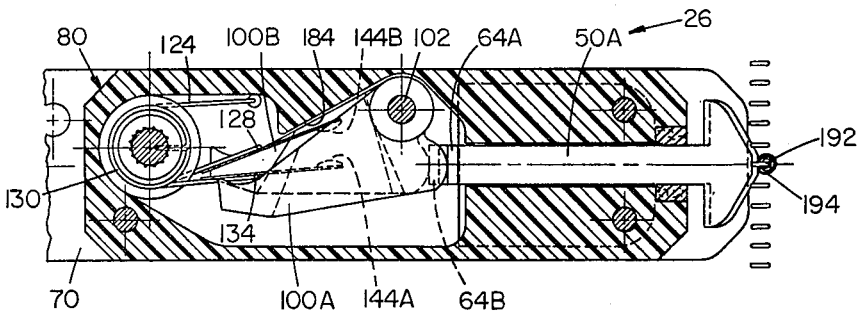
Figure 13:
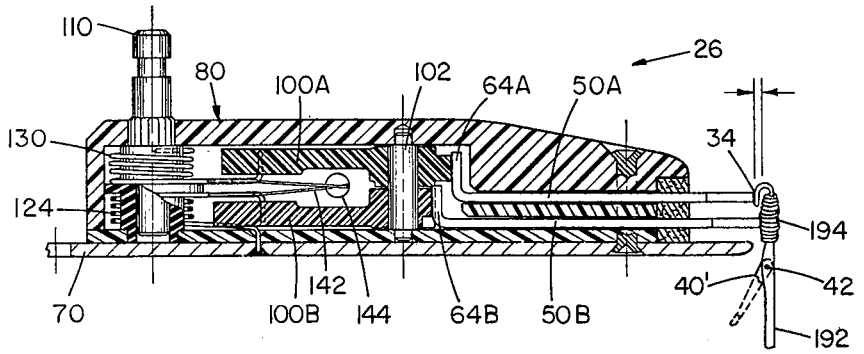

In the case of a broken latch 40', as indicated in FIGS. 12 and 13, the faulty needle 192 ceases to cast off stitches but since its hook is still able to pick up yarn, the stitches accumulate below the hook as indicated at 194 until the needle become "loaded". Whenever any such loaded needle passes in front of the sensor assembly 26, sensor 50A engages the hook 34 and remains in its normal position but the accumulated yarn 194 forces sensor 50B rearwardly into the housing. This reduction in the differential distance produces movement of contact 144B toward stop surface 184 interrupting the control circuit and actuating the stop motion 154 and alarm 156.

Figure 14:
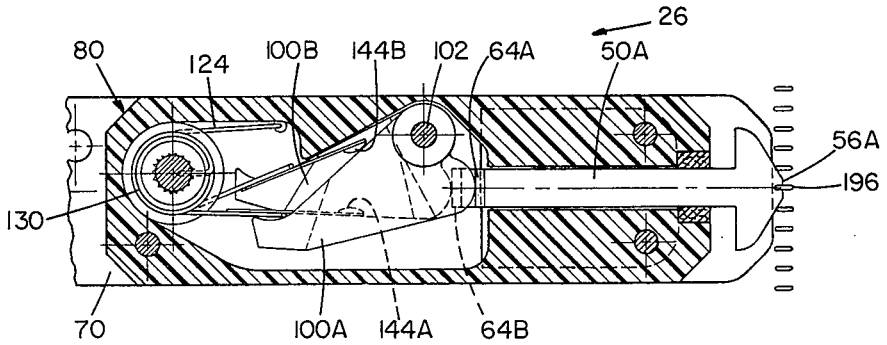
Figure 15:
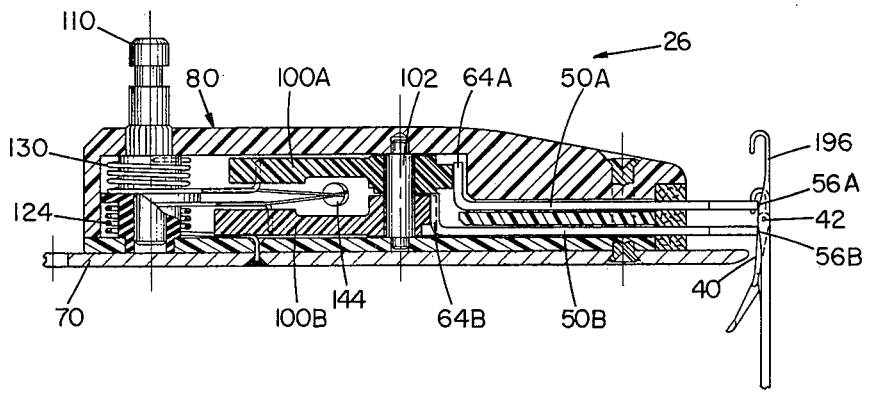

In the case of a broken needle tang, a knitting needle may remain in its high position and fail to knit, as indicated at 196 in FIGS. 14 and 15. When such a faulty needle reaches the sensing station in a high position as shown in FIG. 15 sensor tip surface 56A engages needle 196 just above the latch pivot 42, and sensor tip surface 56B engages that needle just below the latch pivot. The differential distance between the two sensors 50A, 50B is small, the hook sensor 50A being moved forwardly and the stem sensor 50B being moved rearwardly from their normal positions, with corresponding movement of contacts 144A and 144B. As those contacts open, a signal is generated to actuate the alarm 156 and the stop motion 154.

As can be seen from the several preceeding examples, this sensor system is capable of sensing a variety of knitting machine needle failures of the type common in circular machines. The system is relatively insensitive to needle deflection or misalignment since each needle is checked individually without relation to adjacent needles. The sensor system senses two portions of each needle and a defect in the sensed needle is indicated in response to a change in the differential signal.

Another embodiment is shown in FIGS. 16–19. The sensor assembly 26' is similar to that shown in FIGS. 2–4 with a principal difference being that the sensing arms 200A and 200B are secured to the ends of two concentric pivots 202 and 204 to which actuator levers 100A' and 100B' are also secured. Both external sensing arms protrude laterally from housing 80' as shown in FIGS. 16–19. The free extremities of the sensing arms are bent upwardly as seen in FIG. 18 and shaped so as to rest against the knitting needles 10 with minimum interference. The sensing surface 206A of arm 200A normally rests against the needle hooks 34 and is of length sufficient to bridge two hooks 34, and the sensing surface 206B of lower arm 200B normally rests against the stem surfaces 38 and similarly is of length sufficient to bridge two stems 38 as indicated in FIGS. 16 and 18. The upward offset of the end of each sensing arm enables the sensing unit 26' to be installed at a location on the machine where the needles 10 start to rise in the case of cylinder needles (or start to move out in the case of dial needles) to pick up yarn. Where the sensor 26' can be positioned at a location where the needles are fully exposed while traversing horizontally, the sensing arms may be straight.

Each sensing arm is attached by means of a steel pivot to an internal plastic lever 100' which controls the position of a corresponding electrical contact 144'. Sensing arm 200B is attached to its pivot shaft 204 by means of a cold riveted joint 208. The pivot 204 itself passes through second pivot 202 to which sensing arm 200A is secured in similar manner and pivot 202 serves as a journal for pivot shaft 204. The upper end of pivot shaft 204 is supported in a bore in housing 80'. A knurled section 210 of pivot shaft 204 is press fitted into a bore in actuator lever 100B' to provide a rigid connection between the actuator lever and the sensing arm. A similar rigid connection is formed between the upper sensing arm 200A, the hollow steel pivot shaft 202 and the plastic actuator lever 100A' which is similarly press fitted onto a knurled section 212 of the hollow pivot shaft 202. The assembly of the two concentric steel pivots passes at its lower end through a bore in steel base plate 70'. Steel washers 214 serve as thrust bearings and spacers for the sensor components. External stops 216 and 218 limit rotational movement of the sensing arms, and tang 220 on the lower arm 200B limits the relative motion of upper arm 200A. Stops 216 and 218 limit the motion of the sensing arms to a safe level and also prevent damage to internal components in the case of faulty installation or careless handling. Contacts 144', as shown in FIG. 16, are in closed position when the sensing tips 206 of arms 200 have a normal offset. As in the case of the embodiment shown in FIGS. 2–4, torsion springs 124', 130' bias the sensing arms to maintain the sensing surfaces 206 against the needle surfaces being monitored. Each torsion spring 124', 130' has a tang 128', 134', respectively, which is received in a slot 222 in its corresponding actuator lever 100 and carries a fine steel wire 142' to which is secured a contact 144'. A 3:1 kinematic amplification of motion is provided as the distance between the sensing faces 206 and the pivot axis 102' is about two-thirds the distance between the pivot axis and the spring tangs 128', 134' and the contacts 144' are located at about twice the distance of spring tangs 128', 134' from the pivot axis 102'. The system is adjusted so that contacts 144A' and 144B' will not open unless the offset distance 36 is decreased by at least one-third its normal value. The system thus is insensitive to small variations of the differential distance but reliably detects a variety of needle failure modes.

As long as arms 200 sense a series of normal needles, the predetermined offset distance 36 is maintained as indicated in FIG. 19. If a hook is broken, as indicated in FIGS. 20 and 21, the upper arm 200A rotates forward relative to the lower arm 200B; if a needle is missing, as indicated in FIGS. 22 and 23, both arms snap forward with the offset distance being maintained by tang 220; if a latch is closed, as indicated in FIGS. 24–26, or a latch is broken as indicated in FIG. 27, the lower arm 200B rotates rearwardly relative to the upper arm 200A; and if a needle tang is broken and the needle is raised, as indicated in FIGS. 28–30, arm 200A rotates forward.

More specifically, with reference to FIGS. 20 and 21, when a needle that has a broken hook, as indicated at 224 in FIG. 21, is sensed, upper arm 200A moves forward under the influence of torsion spring 124' to rest against the upper stem portion. In this position, as indicated in FIG. 20, contact 144A' has moved away from contact 144B', opening the electrical circuit and actuating the stop motion.

In the case of a missing needle, as indicated in FIGS. 22 and 23, the sensing arms 200A and 200B are both driven forward by their torsion springs 124' and 130' in unison. Internal actuating levers 100A and 100B are simultaneously displaced in the counterclockwise direction, as indicated in FIG. 22, moving the contacts 144A' and 144B' but without separating those contacts so that the electrical circuit is not interrupted. It is preferred that the force of spring 130' is adjusted to be somewhat higher than the force of spring 124' so that arm 200B will be positively driven and its tang 220 will push the upper arm 200A if necessary so that both arms retain the normal offset 226 corresponding to the needle offset 36. This forward motion is stopped by engagement with stop 218. When the next incoming needle 228 arrives at the sensing arms, its hook and stem will contact and move arms 200A and 200B, respectively, rearward. Arm 200A is in engagement with tang 220 of arm 200B and thus moves the lower arm rearward until its sensing surface 206B engages the needle stem. In this position the two arms are in their normal operating configuration and their contacts 144A', 144B' which have remained closed are returned to the position shown in FIG. 16.

Where the needle has a closed latch 40 as indicated in FIGS. 24–26, stem sensing arm 200B is forced rearwardly to a position substantially in alignment with hook sensing arm 200A. In this position contact 144B' is moved away from contact 144A' to open the circuit and produce a stop motion signal. The rearward motion of arm 200B is limited by stop 216 with the result that the passing needle may be slightly deflected while in contact with the face 206B of sensing arm 200B.

Sensing of a broken latch is shown in FIG. 27, the internal action being similar to that in the case of the sticky latch shown in FIGS. 24–26.

Sensing of a needle that remains in its high position is shown in FIGS. 28–30. A stop motion signal is generated as indicated in those figures in manner similar to the operation of the embodiment shown in FIGS. 2–4 and described in connection with FIGS. 14–15. Two high needles 230 and 232 are indicated in FIGS. 28–30. In this embodiment the sensor unit 26' is placed above the needle line, and when the faulty needle reaches the sensing station, it strikes the leading slanted surface 234 of base plate 50' and is deflected around the front of the sensor unit as indicated at the series of dotted positions 236 in FIGS. 28 and 30 and then is sensed by arms 200A and 200B.

Thus the invention senses a variety of common failures in knitting machine needles of the type used in circular machines whether or not needle selection is involved. The system accommodates minor needle deflections and slight misalignments since each needle is checked individually without relation to other adjacent needles and compared with an established standard. The sensing device may be realized in a variety of configurations enabling the unit to be positioned at various locations relative to the needle line without detriment to its sensing function.

While particular embodiments have been shown and described, various modifications of the invention will be apparent to those skilled in the art. For example, while the sensor configurations of the described embodiments have particular advantages, it may be desirable to employ other sensing mechanisms such as electromechanical transducers or non-contact sensors in particular applications. Accordingly, it is not intended that the invention be limited to the disclosed embodiments or to details thereof and departures may be made therefrom within the spirit and scope of the invention as defined in the claims.

What is claimed is:

1. Apparatus for sensing needles of the type employed in a knitting machine comprising:

first and second needle sensors, each said needle sensor having a surface portion for engagement with a portion of a needle, structure supporting said first and second needle sensors in predetermined relation for concurrently sensing different portions of the same needle and producing an output indication thereof, and an indicator coupled to said first and second needle sensors, said indicator being responsive to movement of one sensor relative to the other sensor indicative of a faulty needle for producing an output indicating that the sensed needle is defective.

2. Apparatus for sensing needles of the type employed in a knitting machine comprising:

first and second needle sensors, each said needle sensor including a member mounted for movement relative to the other sensor member and each said sensor member has a surface portion for engagement with the needle portion to be sensed, said needle sensor surface portion having a normal position relative to one another, structure supporting said first and second needle sensors in predetermined relation for concurrently sensing different portions of the same needle and producing an output indication thereof, and an indicator coupled to said first and second needle sensors, said indicator being responsive to movement of said sensor surface portions to a second position relative to one another indicative of a faulty needle for producing an output indicating that the sensed needle is defective.

3. The apparatus as claimed in claim 2 and further including means for urging said sensor surface portions into engagement with said different portions of the same needle.

4. The apparatus as claimed in claim 2 wherein said indicator includes:

first and second indicator members, said indicator members being mounted for movement relative to one another between a first position and a second position, each said indicator member being coupled to a corresponding needle sensor for movement in response to movement of its corresponding sensor, and output means responsive to movement of said first and second indicator members to said second position to produce said output indicating that the sensed needle is defective.

5. The apparatus as claimed in claim 4 and further including biasing means acting on said indicator members for urging said sensor surface portions into engagement with said different portions of the same needle.

6. The apparatus as claimed in claim 4 wherein each said indicator member is a pivotally mounted lever member, each said lever member having a first surface coupled to a corresponding sensor member and a second surface coupled to said output means, the moment arm of said second surface being greater than the moment arm of said first surface.

7. The apparatus as claimed in claim 4 wherein said output means includes two electrical switch contacts, a support member connected to each said switch contact, corresponding spring means connected to each said support member for imposing a bias on each said contact member, each said spring member also imposing a biasing force on a corresponding indicator member, and each said indicator member acting against a corresponding needle sensor so that movement of a needle sensor is coupled by an indicator member and a support member for moving a corresponding switch contact.

8. The apparatus as claimed in claim 4 wherein said indicator members are mounted for movement independently of one another, and further including stop structure for limiting the absolute movement of each said indicator member and structure for limiting the movement of said needle sensor surface portions relative to one another.

9. The apparatus as claimed in claim 2 and further including structure supporting said sensor members for sliding movement relative to one another.

10. The apparatus as claimed in claim 2 and further including structure supporting said sensor members for rotational movement relative to one another.

11. The apparatus as claimed in claim 2 wherein each said sensor surface is of length sufficient to bridge two adjacent needles in the needle array being sensed.

12. The apparatus as claimed in claim 2 wherein said sensor surface of said first and second needle sensors are disposed in spaced, aligned relation for sensing, respectively, the hook portion of a needle and the stem portion of that needle immediately below the hook portion.

13. The apparatus as claimed in claim 12 and further including latch closer structure mounted in adjacent spaced relation to the needle sensing surface portions of said needle sensors.

14. The apparatus as claimed in claim 2 wherein each said sensor member further includes a leading surface disposed at an angle to said sensor surface portion for camming engagement with surfaces of needles in the array to be sensed.

15. The apparatus as claimed in claim 2 wherein said needle sensor surface portions have a normal value of offset and said indicator responds to a change in said offset from said normal value.

16. The apparatus as claimed in claim 15 wherein said indicator produces said indicator output only in response to a reduction of at least 0.010 inch in the offset of said needle sensor surface portions from said normal value.

17. In a knitting machine having a frame and an array of needles in series arrangement, each said needle having a stem, a hook portion at one end of said stem and a latch pivotally mounted on said stem at a position spaced from said hook portion and adapted to cooperate with said hook portion, first and second needle sensors, each said needle sensor being adapted to sense a portion of a needle, structure supporting said first and second needle sensors in predetermined relation so that said first needle sensor is disposed to engage the hook portion of a needle and said second needle sensor is disposed to concurrently sense a different portion of the same needle, means for producing relative motion between the needles and said sensors so that the needles successively pass said sensors, an indicator coupled to said first and second needle sensors, said indicator being responsive to a differential movement of said first and second needle sensors indicative of a faulty needle for producing an output indicating that the sensed needle is defective, and means responsive to said indicator output for stopping said knitting machine.

18. In a knitting machine having a frame and an array of needles in series arrangement, each said needle having a stem, a hook portion at one end of said stem and a latch pivotally mounted on said stem at a position spaced from said hook portion and adapted to cooperate with said hook portion, first and second needle sensors, each said needle sensor being adapted to sense a portion of a needle, each said sensor including a member mounted for movement relative to the other sensor member and each said sensor member having a surface portion of length sufficient to bridge two, but not three, adjacent needles in the needle array being sensed for engagement with the needle portion to be sensed, structure supporting said needle sensor surface portions in predetermined normal offset position relative to one another so that said first needle sensor is disposed to sense the hook portion of a needle and said second needle sensor is disposed to concurrently sense a different portion of the same needle, means for producing relative motion between the needles and said sensors so that the needles successively pass said sensors, an indicator coupled to said first and second needle sensors, said indicator producing an output indicating that the sensed needle is defective only in response to movement of said sensor surface portions to a second relative position in which the offset is reduced to less than three-quarters of said normal offset position, and means responsive to said indicator output for stopping said knitting machine.

19. The apparatus as claimed in claim 18 wherein said indicator includes:

first and second indicator members, said indicator members being mounted for movement relative to one another between a first position and a second position, each said indicator member being coupled to a corresponding needle sensor for movement in response to movement of its corresponding sensor, and output means responsive to movement of said first and second indicator members to said second position to produce said output indicating that the sensed needle is defective.

20. The apparatus as claimed in claim 19 wherein each said indicator member is a pivotally mounted lever member, each said lever member having a first surface coupled to a corresponding sensor member and a second surface coupled to said output means, the moment arm of said second surface being greater than the moment arm of said first surface, and said output means includes two electrical switch contacts, a support member connected to each said switch contact, corresponding spring means connected to each said support member for imposing a bias on each said contact member, each said spring member also imposing a biasing force on a corresponding indicator member, and each said indicator member acting against a corresponding needle sensor so that movement of a needle sensor is coupled by an indicator member and a support member for moving a corresponding switch contact.

21. The apparatus as claimed in claim 20 wherein said indicator members are mounted for movement independently of one another, and further including stop structure for limiting the absolute movement of each said indicator member and tab structure on at least one of said sensor members for limiting the movement of said sensor members relative to one another.

22. The apparatus as claimed in claim 21 and further including structure supporting said sensor members for sliding movement relative to one another.

23. The apparatus as claimed in claim 21 and further including structure supporting said sensor members for rotational movement relative to one another.

* * * * *